United States Patent [19]

Kameyama et al.

[11] Patent Number: 4,619,518

[45] Date of Patent: Oct. 28, 1986

[54] TWO-COLOR IMAGE FORMING APPARATUS

[75] Inventors: Kazuhiro Kameyama; Nobuo Akiba, both of Higashiyamatoshi, Japan

[73] Assignees: Casio Electronics Mfg. Co., Ltd.; Casio Computer Co., Ltd., both of Tokyo, Japan

[21] Appl. No.: 759,326

[22] Filed: Jul. 26, 1985

[30] Foreign Application Priority Data

Jul. 31, 1984 [JP] Japan ..... 59-159285

[51] Int. Cl.[4] ..... G03G 15/00; G03G 15/01

[52] U.S. Cl. ..... 355/4; 355/3 DD

[58] Field of Search ..... 355/4, 3 DD, 140, 3 R

[56] References Cited

U.S. PATENT DOCUMENTS 4,086,006 4/1978 Hauser et al. ..... 355/3 DD
4,308,821 1/1982 Matsumoto et al. ..... 355/4 X
4,395,112 7/1983 Miyakawa et al. ..... 355/3 DD X
4,413,899 11/1983 Karasawa et al. ..... 355/4
4,416,533 11/1983 Tokunaga et al. ..... 355/4
4,486,089 12/1984 Itaya et al. ..... 355/3 DD
4,538,898 9/1985 Kanno et al. ..... 355/3 DD

*Primary Examiner*—A. C. Prescott
*Attorney, Agent, or Firm*—Sandler & Greenblum

[57] ABSTRACT

When, in a two-color image forming apparatus, a first visible image is formed on a photosensitive drum, and sequentially a second visible image is formed on the drum on which the first visible image remains, said second visible image being different in color from said second visible image, a cylindrical non-magnetic sleeve rotates in a direction opposite to a rotation of a permanent magnet equipped with the sleeve, thereby enabling a developer to be conveyed in a direction opposite to a rotation of the permanent magnet.

8 Claims, 9 Drawing Figures

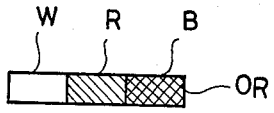
FIG. 3A
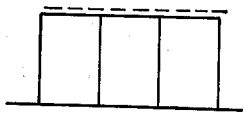
FIG. 3B
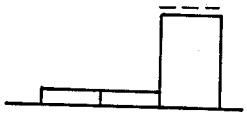
FIG. 3C
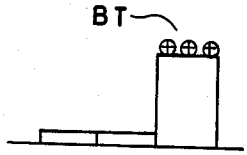
FIG. 3D
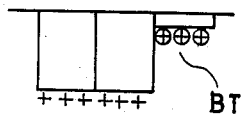
FIG. 3E
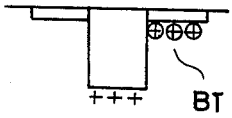
FIG. 3F
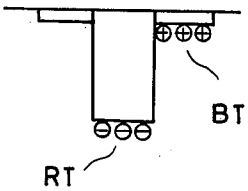

TWO-COLOR IMAGE FORMING APPARATUS

BACKGROUND OF THE INVENTION

1. Field of the Invention

The present invention relate to a two-color image forming apparatus.

2. Description of the Prior Art

Generally, a two-color image forming apparatus employs a process of sequentially performing two-color developments. When the second color development is conducted, it is important from the viewpoint of the picture quality that the second color development is conducted without disturbing a visible image of the first color which has been formed.

The means proposed for the above purpose are as follows:

(1) The direction of transportation for the magnetic brush in the magnetic brush developing apparatus of a fixed magnetic roll and rotating sleeve type for performing the second color development is made the same as the moving direction of a photosensitive body around the development section and made similar in speed to the rotation of the photosensitive body, thereby causing brushing or frictional power of the magnetic brush against the photoconductive body surface weaker than the brushing power of the magnetic brush for the first color.

(2) The density of the magnetic flux of the main pole of the development of the magnetic roll in the developing apparatus for second color is made smaller than that of the magnetic roll of the development apparatus for the first color.

(3) The space between the magnetic roll of the developing apparatus for the second color and the surface of the photoconductive body is made longer than that between the magnetic roll of the developing apparatus for the first color and the surface of the photoconductive body.

(4) Two-component developing agents including an insulating toner are used for the development of the second color and the magnetic roll and sleeve are rotated in the same direction.

However, according to the means (1)–(3), the development condition is deteriorated, a sufficient density of the color cannot be obtained and the picture quality of the second color is lowered. According to the means (2), the magnetic power is weakened and a carrier attachment to the photoconductive body occur easily. Further, according to the means (4), the development agent is transported onto the sleeve, being subjected to a self rotation and the transportation of the developer can be performed in a gentle manner. Therefore, the visible image of the first color is not disturbed and the means (4) is effective for the development of the second color. However, the effectiveness of the transportation is not sufficient and the magnitude of the carrier is limited. Therefore, when the potential difference of the electrostatic latent images between positive and negative polarities corresponding to each color is determined large, the carrier attachment easily occurs, especially around the edge section. The means for causing the magnetic roll and sleeve to rotate in the same direction necessitates a high accuracy of a parts position matching as the allowance of the blade gap and the development gap is small and scatters a development or a developer to a large extent, for the transportation directions of the developing agent on the sleeve are opposite to from two layers of the transportation.

As to the problem that a carrier of the development agent is attatched to the visible image of the other color, it is proposed that the electric resistivity of a sleeve upon the first color development is made different from that upon the second color development and that the volume electric resistivity and the particle radius of a magnetic carrier of a development agent are different between the first color development and the second color development. However, the actual performance of the above proposals does not produce desired effects.

SUMMARY OF INVENTION

In consideration of the above defects of the prior art, the present invention is aimed at providing a two-color image-forming apparatus in which a desturbance of the first picture image upon the second development and an attatchment of a carrier to a photoconductive body is prevented, thereby a producing a two-color picture image of a high quality.

According to one of the features of the present invention, there is provided a two-color image-forming apparatus in which a two-color image forming apparatus comprises a mean for forming a first visible image on an image bearing member, a means for forming a second visible image on said image bearing member still carrying the first visible image, with said second visible image being different in color from said first visible image and a means for causing a cylindrical non-magnetic sleeve and permanent magnetic roll equipped within said non-magnetic sleeve to rotate in an opposite direction with regard to each other, thereby allowing a developer for the second visible image to be conveyed onto said non-magnetic sleeve in a direction opposite to the rotation of said permanent magnetic roll.

BRIEF DESCRIPTION OF THE DRAWINGS

FIGS 3A–3F are schimatic views showing how the potential on the surface of a photoconductive drum is changed in the process of forming a two-color image.

DETAILED DESCRIPTION OF THE PREFERRED INVENTION

One embodiment of the present invention will be explained by referring to attached drawings.

Figure 2:
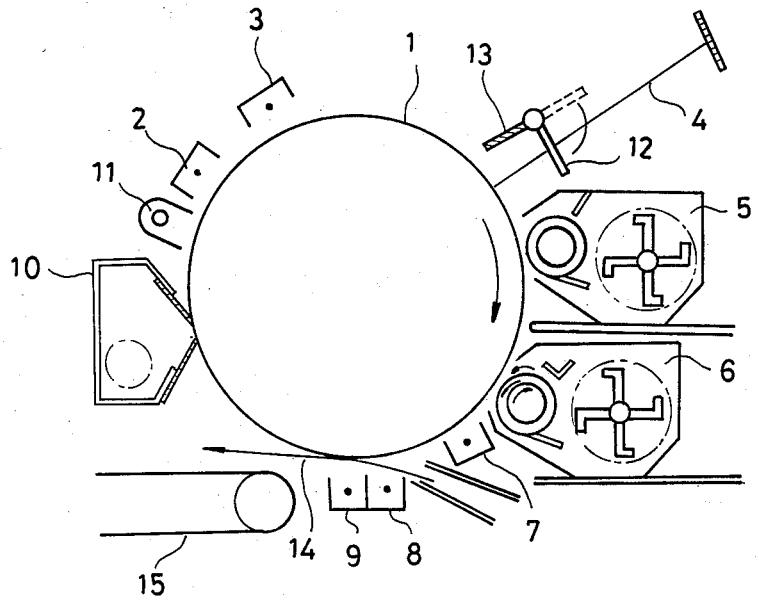
FIG. 2 is a sectional view of a two-color image forming apparatus according to the embodiment of the present invention.

FIG. 2 shows a constructed diagram of one embodiment of the two-color image forming apparatus according to the present invention.

In FIG. 2, the photosensitive body 1 is formed by providing a photoconductive layer of both polarities which comprises an amorphous silicon or organic photoconductive body on a conductive substrate such as alminum and is supported in such a manner as to be rotatable as indicated by the arrow.

Around the circumference of the drum 1 are located chargers 2 and 3 for charging the surface of the photoconductive drum 1 to have the respective polarities, the first developing apparatus 5 and the second developing apparatus 6 for developing an electrostatic latent image formed by an exposure 4, a polarity matching apparatus 7 for arranging the tonal image to have the same polarity before a transferring process, a transferring apparatus 8 for transferring the tonal image to an image transferring paper 14, a separater 9 for separating a transferring paper 14 from photosensitive drum 1 and further, a cleaning apparatus 10, and an eraser lamp 11. The exposure 4 is conducted by radiating a light from an illumination lamp 6 which is not shown) onto the original and by radiating the reflected light from the original through a red filter 12 and cyanic filter 13.

The operation of forming a two-color picture image by the two-color image forming apparatus as described above is explained by referring to FIGS. 3A to 3F showing a change of the surface potential of the photosensitive body 1 of FIG. 2.

First, the surface of the photosensitive body 1 is uniformly negatively charged by the charger 2 for the first charging and an optical image of the two-color original having a red color portion R and a black color portion B on a white ground W is exposed onto the photosensitive body 1 through the red filter unit 12. The electric charge of those portions on the photosensitive body 1 which correspond to a red color portion and a white color portion is attenuated by the light and the surface potential is lowered from the initial level of FIG. 3A to the level of FIG. 3B. The electric charge of that portion of the photosensitive body 1 which corresponds to the black portion is not attenuated by the light and the surface potential maintains the initial level to form the first electrostatic latent image.

This first electrostatic latent image is developed in black by the first developing apparatus 5 according to the magnetic brush developing method and, then the black toner BT positively charged, as shown in FIG. 3C is attached to only a portion corresponding to the black color, thereby forming the first visual image of the black color. The potential of that portion which corresponds to a black color and which is developed in black is not changed so much as compared with FIG. 3B.

When an appropriate voltage is determined, and the photosensitive drum 1 is positively charged, using the reverse-polarity charging charger 3, the potential polarity in the white and red areas is inverted to positive, but the surface potential in the black area is reduced to almost zero at the potential level by the positive polarity charge, as shown in FIG. 3D, because the black area has been charged high in negative polarity potential.

When exposure is carried out again through the cyanic filter 13 which shields the red light component, the potential in the white area is largely light-attenuation because it is left without irradiation, but only to form a second electrostatic latent image as shown in FIG. 3E. The thus-formed second electrostatic latent image is developed in red by the second developing means 6, which contains the negatively-charged red toner RT, to form a second red visual image. Two-color toner images are formed on the photoconductive drum 1 (FIG. 3F), as described above. The polarity of one of these two-color toner images which are different from each other in polarity, is inverted to that of the other to make their polarities the same. They are then transferred to the image transferring paper 14 by the transferring means 8, the image transferring paper 14 is separated from the photosensitive drum 1 by the separator means 9 and fed to a fixing section (not shown) by a feeding means 15 to finally produce a two-color image after the fixing process. The still-remaining toner and electric charge on the photosensitive drum 1 are eliminated by the cleaning means 10 and the erasor lamp 11 to make the photosensitive drum 1 ready for the next image formation.

Figure 4:
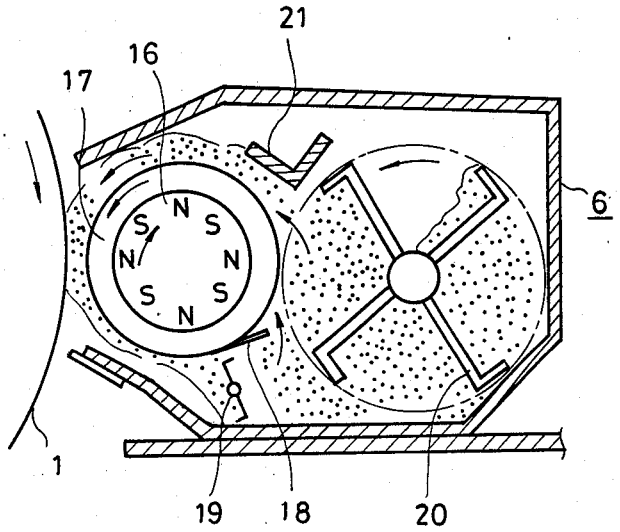
FIG. 4 is a sectional view showing a developing means employed by the embodiment of the present invention.

FIG. 4 shows an arrangement of the second developing means 6, which comprises a developing roll including a permanent magnetic roll 16 and a non-magnetic sleeve 17, a scraper 18, a feeding means 19, a stirring means 20 and a doctor blade 21.

The permanent magnetic roll 16 rotates clockwise, but the non-magnetic sleeve 17, located on a circle concentric with the outer circumference of the permanent magnetic roll 16, rotates independently of the roll 16, in a direction (or anti-clockwise) reverse to that of the roll 16.

The scraper 18 is located under the non-magnetic sleeve 17, contacting the outer circumference of the sleeve 17 at one end thereof, and the small-sized feeding means 19 is located under the scraper 18. The stirring means 20 is juxtaposed with the feeding means 19, and the doctor blade 21 is located above the nonmagnetic sleeve 17.

Figure 1:
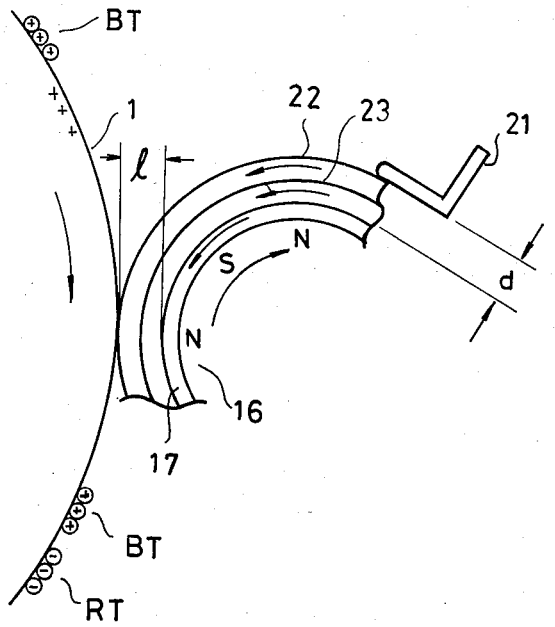
FIG. 1 is a sectional view of a development area of an embodiment of the present invention.

At the time of development, the developer forms two soft developing agent layers which comprise an upper layer 22 rotating and travelling anti-clockwise on the non-magnetic sleeve 17, due to the rotating magnetic field of the permanent magnetic roll 16 which rotates clockwise, and a lower layer 23, similarly travelling anti-clockwise due to its frictional force against the surface of the non-magnetic sleeve 17 which rotates anti-clockwise (see FIG. 1). These developing agent layers are defined by the doctor blade 21 to have a certain thickness of layers and contact the photosensitive drum 1 to carry out development.

In the case where the permanent magnetic roll 16 rotates in a direction reverse to that of the non-magnetic sleeve 17, as described above, the flow of the developing agent is directed in one direction (or the developing agent is divided into two upper and lower layers 22 and 23 and they are fed in the same direction). Therefore, carriers each having a large carrying force and a sufficiently large particle diameter can be employed. In addition, the developer is not scattered and its flow is not directed to the reverse direction. Therefore, the carriers are likely to be influenced by magnetic force emitted from the permanent magnetic roll 16, thereby preventing almost all of the carriers from adhering to the photosensitive drum 1.

Providing that the interval between the doctor blade 21, which defines the developer layers this time, and the non-magnetic sleeve 17 (or thickness of the developer layers defined) is represented by d and that the interval between the non-magnetic sleeve 17 and the surface of the photosensitive drum 1 (or developing gap) is denoted by l, the most suitable images can be obtained under a condition of $0.8d \leqq l \leqq 1.2d$. More concrete results shown in a Table 1, for example, were obtained when the rotation number of the permanent magnetic roll 16 was 920rpm, that of the non-magnetic sleeve 17 20rpm, and $l = 1.0$mm, but changing d. Symbol O means good and symbol X bad in Table 1.

TABLE 1

| d(mm) | 1.4 | 1.2 | 1.0 | 0.8 | 0.6 |
|---|---|---|---|---|---|
| Developing Status | | | | | |
| Density | O | O | O | O | X |
| Scattering | X | O | O | O | O |

Other results shown in a Table 2 are obtained when the rotation numbers of the permanent magnetic roll 16 and non-magnetic sleeve 17 were left as they were and l=0.6mm, but changing d.

TABLE 2

| d(mm) | 0.8 | 0.7 | 0.6 | 0.5 | 0.3 |
|---|---|---|---|---|---|
| Developing Status | | | | | |
| Density | O | O | O | O | X |
| Scattering | X | O | O | O | O |

When l=1.0mm and d=1.0mm, but by changing the rotation numbers of the permanent magnetic roll 16 and non-magnetic sleeve 17, such results as shown in a Table 3 were obtained, wherein Nm represents the roration number of the permanent magnetic roll and Ns that of the non-magnetic sleeve 17.

TABLE 3

| Nm | 100 | 460 | 920 | 920 | 920 |
|---|---|---|---|---|---|
| Ns | 20 | 20 | 20 | 100 | 0 |
| Developing Status | irregular in images | almost good | good | developing agent scattered | no density |

According to the results shown in Table 3, good images can be obtained when Nm/Ns ≦10. The developer used is preferably of the type that at least toner and carriers are included, that the surface of each of the carriers is covered by resin and no magnetic material is exposed on the surface of each of the carriers, thereby enabling the resin on the surface of each of the carriers to serve as a damper material to reduce the influence exerted from the carriers even when the carriers contact the first image on the photosensitive drum 1, and that it is lighter in specific gravity than such carriers as the usual iron powder carriers including no resin, to reduce the impact force of the magnetic brush against the surface of the photosensitive drum.

In the case of the above-described carrier particles, polyethylene, polyacrylic acid ester, polystyrene, epoxy resin, polymethylmethacrylate, and the like are used as insulating resin, while iron oxide powder, reduced iron powder, ferrite and the like are employed as magnetic fine powder. The resin and the magnetic fine powder, and a filling material such as a charge control agent, if necessary, are solved, mixed, cooled and finely grounded, then its particle size is selected. In order to prevent any magnetic material from being exposed on the surface of each of the carrier particles, a core which contains the magnetic fine powder may be capsulized by an optional resin according to the surface polymerization, polymer deposition or the like to form a particle which serves as a carrier.

When the ratio of the magnetic material contained is too high, the magnetic material is exposed on the surface of each of the carrier particles and the impact force of the magnetic brush against the photosensitive drum is increased, thereby lowering the above-described effects. When too low, carrying capacity is made worse and a large amount of the developer is scattered. It is therefore preferable that the ratio of the magnetic material contained is in the range of 30–90 weight % (or more preferably 60–80 weight %).

In the case of the above-described embodiment, the developer has beeh carried in the same direction as the rotating direction of the photosensitive drum 1 at the contact section between the developer and the drum, but it is apparent that excellent development can be achieved even when the developer is carried in a direction reverse to the rotating direction of the photoconductuve drum.

As described above, the two-color image forming apparatus of the present invention can prevent the first image from being disturbed and the carriers from adhering to the photosensitive drum at the time of second development, so that it can form two-color images of high quality.

What is claimed is

1. A two-color image forming apparatus comprising means for forming a first visible image on an image bearing member, means for forming a second visible image on said image bearing member still carrying the first visible image, with said second visible image being different in color from said first visible image, and means for rotating a cylindrical non-magnetic sleeve and a permanent magnetic roll equipped within said non-magnetic sleeve in opposite directions with regard to each other, thereby allowing a developer for the second visible image to be conveyed onto said non-magnetic sleeve in a direction opposite to the rotation of said permanent magnetic roll.

2. The two-color image forming apparatus according to claim 1, wherein the development gap l is more than 0.8.d and less than 1.2.d, where l is the distance between the image bearing member and non-magnetic sleeve and d is the defined thickness of the developer for the second visible image.

3. The two-color image forming apparatus according to claim 1, wherein said developer for the second visible image has at least a toner and carrier, with said carrier comprising fine magnetic particles dropped into an insulative resin.

4. The two-color image forming apparatus according to claim 3, wherein said fine magnetic particles are barely exposed from the surface of said carrier.

5. The two-color image forming apparatus according to claim 3, wherein the rate of said fine magnetic particles contained in said carrier ranges from 30 to 90 percent by weight.

6. The two-color image forming apparatus according to claim 1, wherein the rotation speed of said permanent magnetic roll is more than ten times greater than that of said non-magnetic sleeve.

7. The two-color image forming apparatus according to claim 2, wherein said developer for the second visible image has at least a toner and carrier, with said carrier comprising fine magnetic particles dropped into an insulative resin.

8. The two-color image forming apparatus according to claim 2, wherein the rotation speed of said permanent magnetic roll is more than ten times greater than that of said non-magnetic sleeve.

* * * * *

UNITED STATES PATENT AND TRADEMARK OFFICE

CERTIFICATE OF CORRECTION

PATENT NO. : 4,619,518

DATED : October 28, 1986

INVENTOR(S) : Kazuhiro KAMEYAMA et al.

It is certified that error appears in the above-identified patent and that said Letters Patent is hereby corrected as shown below:

At column 1, line 7 change "relate" to ---relates---;

At column 1, line 50, change "occur" to ---occurs---;

At column 2, line 4, change "attatched" to ---attached---;

At column 2, line 17, change "destrubance" to ---disturbance---;

At column 2, line 19, change "attatchment" to ---attachment---;

At column 2, line 20, delete "a" (first occurrence);

At column 2, line 25, change "mean" to ---means---;

At column 2, line 44, change "schimatic" to ---schematic---;

At column 1, line 46, change "," to ---;---;

At column 2, line 62, change "alminum" to ---aluminum---;

At column 2, line 66, insert ---so as--- after "drum 1";

At column 3, line 2, insert ---so as--- after "image";

At column 3, line 9, change "lamp 6" to ---lamp (---;

At column 3, line 64, change "," to ---;---;

At column 4, line 56, delete "a";

At column 5, line 1, delete "a";

At column 5, line 14, delete "a";

At column 5, line 16, change "roration" to ---rotation---;

UNITED STATES PATENT AND TRADEMARK OFFICE

CERTIFICATE OF CORRECTION

PATENT NO. : 4,619,518

DATED : October 28, 1986

INVENTOR(S) : Kazuhiro KAMEYAMA et al.

It is certified that error appears in the above-identified patent and that said Letters Patent is hereby corrected as shown below:

At column 5, line 27, change "the type" to ---a type such---;

At column 5, line 28, insert ---so--- before "that";

At column 5, line 33, change "from" to ---by---;

At column 5, line 35, change "," to ---;---;

At column 5, line 37, change "including" to ---which include---;

At column 6, lines 9-10, change "photoconductave" to ---photoconductive---; and

At column 6, line 46, "rate" should be changed to "proportion".

Signed and Sealed this

Twenty-fourth Day of November, 1987

*Attest:*

*Attesting Officer*

DONALD J. QUIGG

*Commissioner of Patents and Trademarks*